US007919048B2

(12) United States Patent
Wo et al.

(10) Patent No.: US 7,919,048 B2
(45) Date of Patent: Apr. 5, 2011

(54) CELLULAR MICROARRAY AND ITS MICROFABRICATION METHOD

(75) Inventors: Andrew M. Wo, Taipei (TW); Lo-Chang Hsiung, Taipei (TW); Chun-Hui Yang, Taipei (TW); Hsin-Yu Lee, Taipei (TW)

(73) Assignee: National Taiwan University, Taipei (TW)

( * ) Notice: Subject to any disclaimer, the term of this patent is extended or adjusted under 35 U.S.C. 154(b) by 264 days.

(21) Appl. No.: 12/149,030

(22) Filed: Apr. 25, 2008

(65) Prior Publication Data

US 2009/0093376 A1 Apr. 9, 2009

(30) Foreign Application Priority Data

Oct. 5, 2007 (TW) ..... 96137479 A

(51) Int. Cl.
*C40B 60/02* (2006.01)

(52) U.S. Cl. ..... 422/101; 204/403.01; 204/547; 435/174; 435/283.1; 436/177; 506/14

(58) Field of Classification Search ..... 506/14; 204/547; 422/101; 435/174, 283.1; 436/177
See application file for complete search history.

(56) References Cited

U.S. PATENT DOCUMENTS 5,795,457 A 8/1998 Pethig
6,936,151 B1 8/2005 Lock

FOREIGN PATENT DOCUMENTS

WO WO 2007/079663 A1 7/2007

OTHER PUBLICATIONS

Chen-Ta Ho et al., "Rapid heterogeneous liver-cell on-chip patterning via the enhanced field-induced dielectrophoresis trap", Lab Chip, May 2006, 724-734, 2, The Royal Society of Chemistry.
Dirk R Albrecht et al., "Probing the role of multicellular organization in three-dimensional microenvironments", Nature Methods, May 2006, 369-375, vol. 3, No. 5, Nature Publishing Group.
Brian M. Taff and Joel Voldman, "A scalable addressable positive-dielectrophoretic cell-sorting array", Analytical Chemistry, Dec. 2005, 7976-7983, vol. 77, No. 24, American Chemical Society.
Luc Barraud et al., "Increase of doxorubicin sensitivity by doxorubicin-loading into nanoparticles for hepatocellular carcinoma cells in vitro and in vivo", Journal of Hepatology, 2005, 736-743, vol. 42, Elsevier.
Ying Huang et al., "Dielectrophoretic cell separation and gene expression profiling on microelectronic chip arrays", Analytical Chemistry, Jul. 2002, 3362-3371, vol. 74, No. 14, American Chemical Society. Patrick N. Gilles et al., "Single nucleotide polymorphic discrimination by an electronic dot blot assay on semiconductor microchips", Nature Biotechnology, Apr. 1999, 365-370, vol. 17, Nature America Inc.

(Continued)

*Primary Examiner* — In Suk Bullock
*Assistant Examiner* — Timothy G Kingan
(74) *Attorney, Agent, or Firm* — Bacon & Thomas PLLC

(57) ABSTRACT

A cellular microarray is disclosed, which has a substrate, multiple first conductive lines, multiple second conductive lines, and multiple PIREs arranged on the surface of the substrate in an array. Each PIRE includes multiple first ring-shaped electrodes, and multiple second ring-shaped electrodes. The first ring-shaped electrodes, and the second ring-shaped electrodes are located on the surface of the substrate alternately in each PIRE. Moreover, the outermost ring-shaped electrodes of any two adjacent feather-shaped electrodes are different. The disclosed cellular microarray can adhere the cells rapidly and uniformly, increase the output of manufacturing, and reduce the cost for manufacturing and application.

18 Claims, 7 Drawing Sheets

(A)

(B)

(C)

(A)

(B)

CELLULAR MICROARRAY AND ITS MICROFABRICATION METHOD

BACKGROUND OF THE INVENTION

1. Field of the Invention

The present invention relates to a microarray chip and, more particularly, to a cellular microarray which is used for cellular-adhesion via dielectrophoresis.

2. Description of Related Art

Currently, the cellular microarray has become a focus due to that it can be widely used in medical diagnosis, drug screening, and cellular research. For example, various cells can be planted to a cellular microarray, and then reagents are delivered to the cellular microarray to test the chemical interaction with these cells. Using the method illustrated above can rapidly detect the interactions between the drugs and the various cells at the same time. Hence, the cellular microarray can be employed in research and in clinical application to save time and improve the screening efficiency. However, planting cells by point to point through arrayers to manufacture the general cellular microarray is very time-consuming (about ten hours to several days) and extremely expensive. Hence, even though the cellular microarray has the potential for widely-spread application, it is difficult to employ the cellular microarray in research and clinical application at a large scale.

Many studies have indicated that cellular microarray is a convenient and efficient tool for pathological classification or drug screening. In addition, in order to upgrade the accuracy of the clinical test, screening the decease-related cells correctly is very essential for making the gene expression profile with high reliability.

In U.S. Pat. No. 6,936,151, Lock et al. have disclosed electrodes for generating and analyzing dielectrophoresis. In a method of manipulating particles suspended in a liquid medium, a moving standing wave ultrasonic vibration and an electrical field capable of generating a dielectrophoretic force on the particles are applied. The ultrasonic vibration may be applied to move the particles from a first suspending liquid to a second suspending liquid, or to move the particles into proximity with electrodes to apply the dielectrophoretic force, or to move the particles into the center of the liquid medium. Alternatively, the ultrasonic vibration and the electrical field may be applied simultaneously.

Furthermore, in U.S. Pat. No. 5,795,457, Pethig et al. have disclosed a method for manipulation of particles. By applying two or more electrical fields (DC, AC, pulsed) of different characteristics to an electrode array on e.g. the wall of a treatment cell, particles suspended in liquid in the cell may be manipulated as desired on a microscopic scale, in particular by exploiting the dielectrophoretic properties of the particles. The particles may be solid, semi-solid or liquid, and may be of simple materials or may be biological particles such as whole cells or fragments thereof.

In addition, in WO Patent No. 2007079663, Wang et al. have disclosed a methods for improving efficiency of cell electroporation using dielectrophoresis-assisted cell localization and uses thereof in a microfluidic biochip system. Cells are first subject to dielectrophoresis and localized to regions where the electric field intensity is high enough to render cells electroporated. The invention enhances the efficiency of in situ cell electroporation on a traditional microfluidic biochip.

D. R. Albrecht et al. have disclosed two independent methods for creating living cell arrays that are encapsulated within a poly(ethylene glycol)-based hydrogel to create a local 3-D microenvironment (D. R. Albrecht, et al. *Lab Chip.* 2005, 5, 111-118). First, "photopatterning" selectively crosslinks hydrogel microstructures containing living cells with ~100 μm feature size. Second, "electropatterning" utilizes dielectrophoretic forces to position cells within a prepolymer solution prior to crosslinking, forming cell patterns with micron resolution. D. R. Albrecht et al. further combine these methods to obtain hierarchical control of cell positioning over length scales ranging from microns to centimeters. This level of microenvironmental control should enable the fabrication of next-generation cellular microarrays in which robust 3-D cultures of cells are presented with appropriate physical and chemical cues and, consequently, report on cellular responses that resemble in vivo behavior.

Further, D. R. Albrecht et al. have provided a method for the rapid formation of reproducible, high-resolution 3D cellular structures within a photopolymerizable hydrogel using dielectrophoretic forces (D. R. Albrecht, et al. *Nat Methods.* 2006, 3, 369-375). It shows that the parallel formation of >20,000 cell clusters of precise size and shape within a thin 2-$cm^2$ hydrogel and the maintenance of high cell viability and differentiated cell markers over 2 weeks. By modulating cell-cell interactions in 3D clusters, the results show that microscale tissue organization regulates bovine articular chondrocyte biosynthesis. Hence, this platform permits investigation of tissue architecture in other multicellular processes, from embryogenesis to regeneration to tumorigenesis.

Besides, D. R. Albrecht et al. have also provide a method to form multiphase tissues consisting of microscale tissue subunits in a "local phase" biomaterial, which are organized by dielectrophoresis (DEP) forces in a separate, mechanically supportive "bulk phase" material (D. R. Albrecht, et al. *Lab Chip.* 2007, 7, 702-709). First, D. R. Albrecht et al. define the effects of medium conductivity on the speed and quality of DEP cell patterning. Then, D. R. Albrecht et al. produce multiphase tissues with microscale architecture that combine high local hydrogel conductivity for enhanced survival of sensitive liver progenitor cells with low bulk conductivity required for efficient DEP micropatterning. This approach enables an expanded range of studies examining the influence of 3D cellular architecture on diverse cell types, and in the future may improve the biological function of inhomogeneous tissues assembled from a variety of modular tissue sub-units.

Y. Huang et al. disclosed a microelectronic chip array on a silicon wafer fabricated by semiconductor manufacturing process. The disclosed microelectronic chip array includes plate-electrodes, and agarose covered thereon and functions as a cell adhesion layer. Since different cells have different dielectrophoresis properties, this microelectronic chip array is capable of separating various cells by adjusting the voltage (Y. Huang, et al. *Anal. Chem.* 2002, 74, 3362-3371).

The purpose of Y. Huang et al. is to screen a specific cell type in heterogeneous cells. Therefore, it is possible to screen a specific cell type from heterogeneous cells successfully and to generate the gene expression profile of the specific cell type correctly by using the plate-electrodes. However, the disadvantage of the plate-electrodes is that the distribution of the cells on the electrodes is not uniform, and parts of the electrodes are not adhered with cells.

In addition, C. T. Ho et al. has disclosed a cell-patterning chip, which was manufactured by a microfabrication process. On the cell-patterning chip, many concentric electrodes were formed to mimic the lobular morphology of real liver tissue (C. T. Ho, et al. *Lab Chip.* 2006, 6, 724-734). The applied cell adhesion layer of the cell-patterning chip is poly-D-lysine. Furthermore, many anodes and cathodes were arranged in parallel on the cell-patterning chip to form the concentric electrodes. When ac voltage was applied, the dielectrophoresis force was formed within the cells in the electric field, and the cells were able to distribute on all electrodes of the concentric electrodes. Hence, the cell-patterning chip was able to mimic the lobular morphology of real liver tissue artificially. However, in the process of manufacturing the concentric electrodes, it took at least 12 hours to rinse the flow paths. In this way, it is possible to cover poly-D-lysine on the surface of the concentric electrodes completely. Using the cell-patterning chip illustrated above, the result of cell survival rate test showed that most of the cells were still alive on the electrodes after 1 hour.

Therefore, it is desirable to provide a cellular microarray to overcome the disadvantages illustrated above. Particularly, a cellular microarray, where the cells can be patterned with good uniformity rapidly, is needed. In addition, the cost for manufacturing and using the cellular microarray must be reduced, so that it is possible to apply the cellular microarray in research and clinical application widely.

SUMMARY OF THE INVENTION

The object of the present invention is to provide a cellular microarray, which can adhere cells rapidly and uniformly, simplify the manufacturing process, increase the output of manufacturing, and reduce the cost for manufacturing and application.

To achieve the object, the cellular microarray of the present invention includes: a substrate; a plurality of first conductive lines, which locate on a surface of the substrate; a plurality of second conductive lines, which locate on the surface of the substrate, and the second conductive lines are electrically disconnected to the first conductive lines; and a plurality of planar interdigitated ring electrodes (PIREs). The PIREs are arranged on the surface of the substrate in an array, and each PIRE comprises a plurality of first ring-shaped electrodes and a plurality of second ring-shaped electrodes. Both of the first ring-shaped electrodes and the second ring-shaped electrodes are located on the surface of the substrate, and the first ring-shaped electrodes and the second ring-shaped electrodes of each PIRE are arranged alternately on the surface of the substrate. Further, the first conductive lines are electrically connected to the first ring-shaped electrodes of each PIRE, and the second conductive lines are electrically connected to the second ring-shaped electrodes of each PIRE. In addition, the electrical polarities of the outermost ring electrodes of every two adjacent PIREs are different.

There is no specific limitation for the substrate of the cellular microarray according to the present invention. Preferably, the substrate may be a transparent substrate, or a silicon substrate. The transparent substrate used in the cellular microarray of the present invention is unlimited. Preferably, the transparent substrate may be glass substrate, or transparent resin substrate. In the cellular microarray of the present invention, the first ring-shaped electrodes and the second ring-shaped electrodes of the same PIRE are not electrically connected to each other. After a different voltage is applied, an electric field is formed between the first ring-shaped electrodes and the second ring-shaped electrodes, and cells are adhered to a cell adhesion layer of the PIREs via dielectrophoresis force. The first ring-shaped electrodes and the second ring-shaped electrodes of the same PIRE are extended from and connected to the first conductive lines and the second conductive lines, wherein the first ring-shaped electrodes and the second ring-shaped electrodes are disposed corresponding to each other or surround each other. The outermost ring-shaped electrodes of the same PIRE may be the first ring-shaped electrodes of the second ring-shaped electrodes. Preferably, the outermost ring-shaped electrodes of the adjacent PIREs are the first ring-shaped electrodes or the second ring-shaped electrodes alternately.

There is no specific limitation for the sizes and the shapes of the adjacent PIRE of the cellular microarray according to the present invention. Preferably, the sizes and the shapes of any two adjacent PIREs are the same. In the present invention, the shapes of the PIRE of the cellular microarray are unlimited. Preferably, the edges of the PIRE form a polygon, a circle, or an ellipse. The shapes of the first ring-shaped electrodes or the second ring-shaped electrodes in the same PIRE of the cellular microarray may be identical or different. Preferably, the shapes of the first ring-shaped electrodes or the second ring-shaped electrodes are the same. More preferably, the shapes of the first ring-shaped electrodes or the second ring-shaped electrodes are linear electrodes, poly-segmental electrodes, or arc-shaped electrodes. In the cellular microarray of the present invention, the arrangement of the first ring-shaped electrodes and the second ring-shaped electrodes are unlimited. Preferably, the first ring-shaped electrodes and the second ring-shaped electrodes are arranged in a form of concentric circles, or comb-shapes. In the cellular microarray of the present invention, the gaps between the first ring-shaped electrodes or the second ring-shaped electrodes of the same PIRE is unlimited. Preferably, the gaps between the first ring-shaped electrodes and the adjacent second ring-shaped electrodes of each PIRE are the same, or the gaps between the first ring-shaped electrodes and the adjacent second ring-shaped electrodes of each PIRE increase in a direction from inner electrodes to outer electrodes.

In the cellular microarray of the present invention, widths of the first ring-shaped electrodes and widths of the second ring-shaped electrodes of the same PIRE are not limited. Preferably, widths of the first ring-shaped electrodes and widths of the adjacent second ring-shaped electrodes of the same PIRE are the same. More preferably, widths of the ring-shaped electrodes and widths of the adjacent second ring-shaped electrodes of each PIRE are the same. The amounts of the first ring-shaped electrodes and the second ring-shaped electrodes of the same PIRE are not limited. Preferably, the amounts of the first ring-shaped electrode and the second ring-shaped electrodes of the adjacent PIRE are the same. The edges of the first ring-shaped electrodes of the PIRE may further comprise thorns selectively to increase the electric field during using the cellular microarray so as to enhance the capacity of cell adhesion via dielectrophoresis force. The edges of the second ring-shaped electrodes of the PIRE may further comprise thorns selectively to increase the electric field during using the cellular microarray so as to enhance the capacity of cell adhesion via dielectrophoresis force. In addition, the distances between the adjacent thorns of the first ring-shaped electrodes are not limited. Preferably, every distance between the adjacent thorns of the first ring-shaped electrodes is the same. Furthermore, the distances between the adjacent thorns of the second ring-shaped electrodes are not limited. Preferably, every distance between the adjacent thorns of the second ring-shaped electrodes is the same.

In the cellular microarray of the present invention, the array, which is formed by the arrangement of the PIREs on the substrate, is not limited. Preferably, the PIREs form an m×n array, and each m and n is independently an integer of 1 or more. In the present invention, the first conductive lines and the second conductive lines of the cellular microarray are arranged unlimitedly. Preferably, the first conductive lines and the second conductive lines are arranged alternately on the surface of the substrate, and each PIRE is set between the first conductive line and the second conductive line. More preferably, the first conductive lines and the second conductive lines are parallel with each other. In the cellular microarray of the present invention, the shapes of the first conductive lines and the second conductive lines are not limited. Preferably, the shapes of the first conductive lines and the second conductive lines are linear lines, poly-segmental lines, or curved lines. In addition, the material of the first conductive lines or the second conductive lines, which are electrical connected to the PIREs, are unlimited. Preferably, the material of the first conductive lines or the second conductive lines is metal or transparent electrode material. In the present invention, the transparent electrode material used in the first conductive lines or the second conductive lines of the cellular microarray is unlimited. Preferably, the transparent electrode material is ITO or IZO.

Furthermore, in the cellular microarray of the present invention, the material of the first ring-shaped electrodes and the second ring-shaped electrodes is not limited. Preferably, the first ring-shaped electrodes or the second ring-shaped electrodes are metal electrodes or transparent electrodes. The transparent electrodes used in the cellular microarray of the present invention are unlimited. Preferably, the transparent electrodes are ITO electrodes or IZO electrodes.

The cellular microarray of the present invention may further comprise a cell adhesion layer, which locates on a surface of the each PIRE or on the surface of the substrate, so that cells or culture matrixes may adhere or bind to the cell adhesion layer. Also, the cellular microarray of the present invention may further comprise a concentration gradient generator, which locates above the surface of the substrate to protect the substrate and the plurality of PIREs. Furthermore, the cellular microarray of the present invention may further comprise a concentration gradient generating channel, and a plurality of flow paths selectively. The concentration gradient generating channel and the flow paths can control the concentration of cells or culture matrixes, which flow into the cell adhesion layer on the surfaces of each electrode of the PIREs. In addition, the concentration gradient generating channel and the flow paths are disposed on the surface of the substrate, and the flow paths are connected to the concentration gradient generating channel and the PIREs.

Other objects, advantages, and novel features of the invention will become more apparent from the following detailed description when taken in conjunction with the accompanying drawings.

DETAILED DESCRIPTION OF THE PREFERRED EMBODIMENT

Embodiment 1

Figure 4:
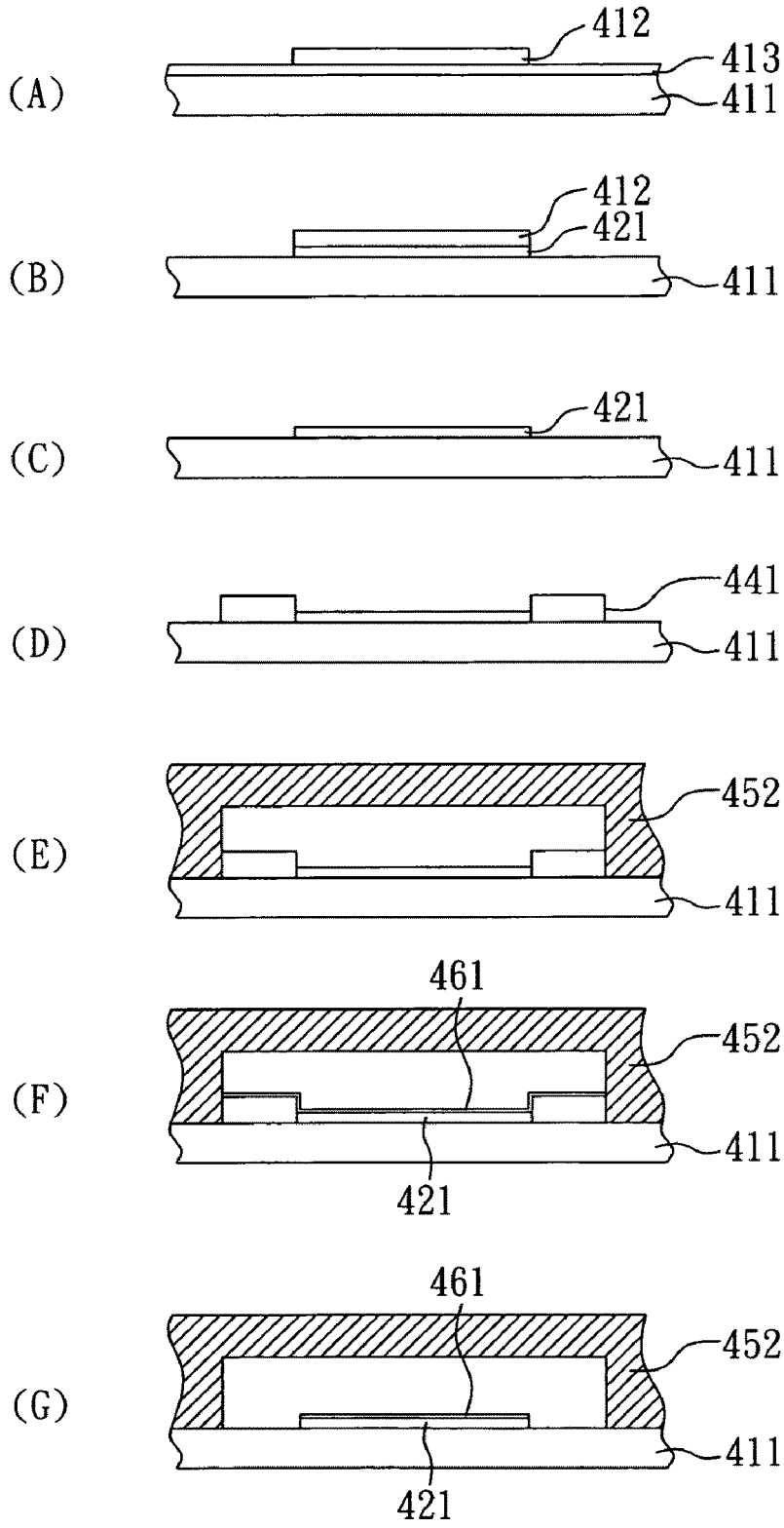
FIG. 4 is a cross sectional view showing the process for manufacturing the cellular microarray in the preferred embodiment of the present invention.

With reference to FIG. 1 and FIG. 4, a cellular microarray 100 comprises a substrate 101, 411, a concentration gradient generating channel 103, repeats of flow paths 107, repeats of first conductive lines 111, repeats of second conductive lines 112, repeats of planar interdigitated ring electrodes (PIREs) 113, and a cell adhesion layer 461.

In addition, as shown in FIG. 1 and FIG. 4, the concentration gradient generating channel 103, flow paths 107, first conductive lines 111, second conductive lines 112, the PIREs 113, the cell adhesion layer 461, and the concentration gradient generating channel of the cellular microarray 100 are disposed on the surface of the substrate 101, 411.

Figure 1A:
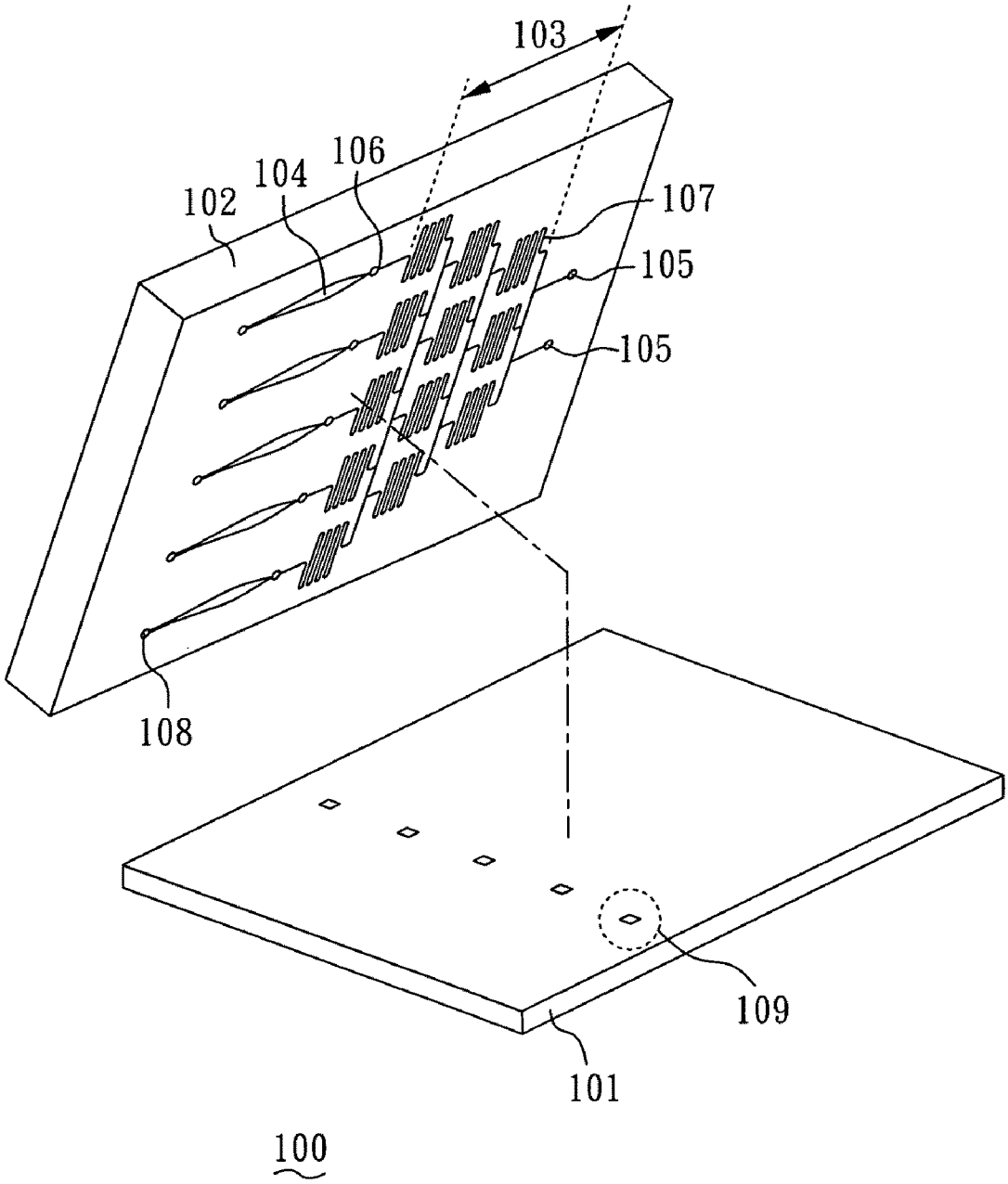
FIG. 1 is a top view of the cellular microarray in a preferred embodiment of the present invention.
Figure 1B:
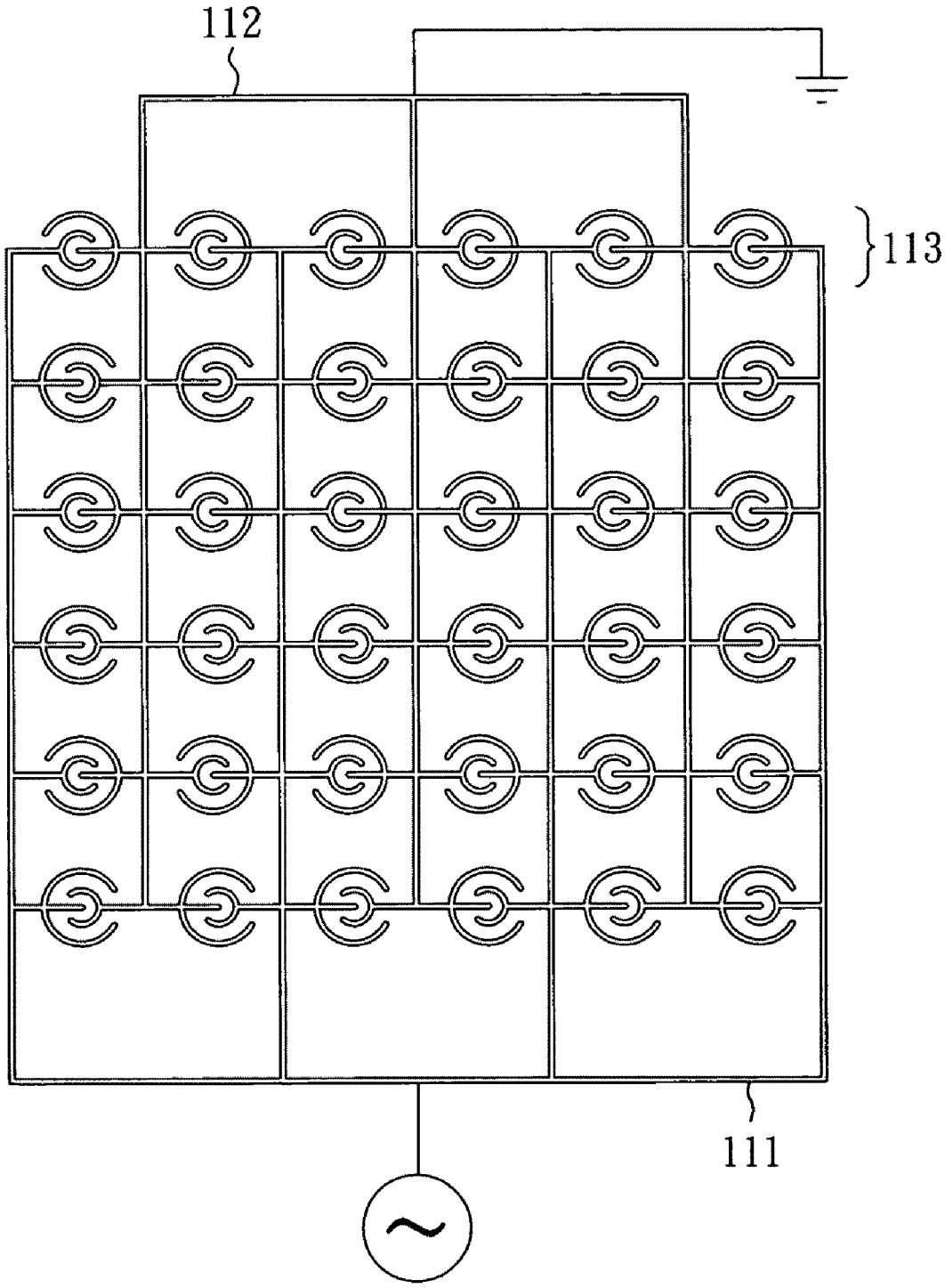

With reference to FIG. 1, FIG. 1B is the enlarged view of the electrode array 109 of the cellular microarray 100 in FIG. 1A. The flow paths 107 are connected to the concentration gradient generating channels 103 and the PIREs 113. Hence, when buffer is injected into inlets 105, the buffer flows from the concentration gradient generating channels 103 to the PIREs 113 through flow paths 107. Thus, when the buffer flows from outlets 105 to the outside, different PIREs 113 are distributed over the buffer with different concentration. In addition, the PIREs 113 are made of ITO to form the transparent electrodes. Furthermore, the PIREs 113 are arranged to form a 6×6 array on the surface of the substrates 101, and the PIREs 113 are disposed between the first conductive lines 111 and the second conductive lines 112. The first conductive lines 111 and the second conductive lines 112, which are disposed on the surface of the substrate 101, are interdigitated, so the first conductive lines 111 and the second conductive lines 112 are not electrically connected to each other.

Figure 2:
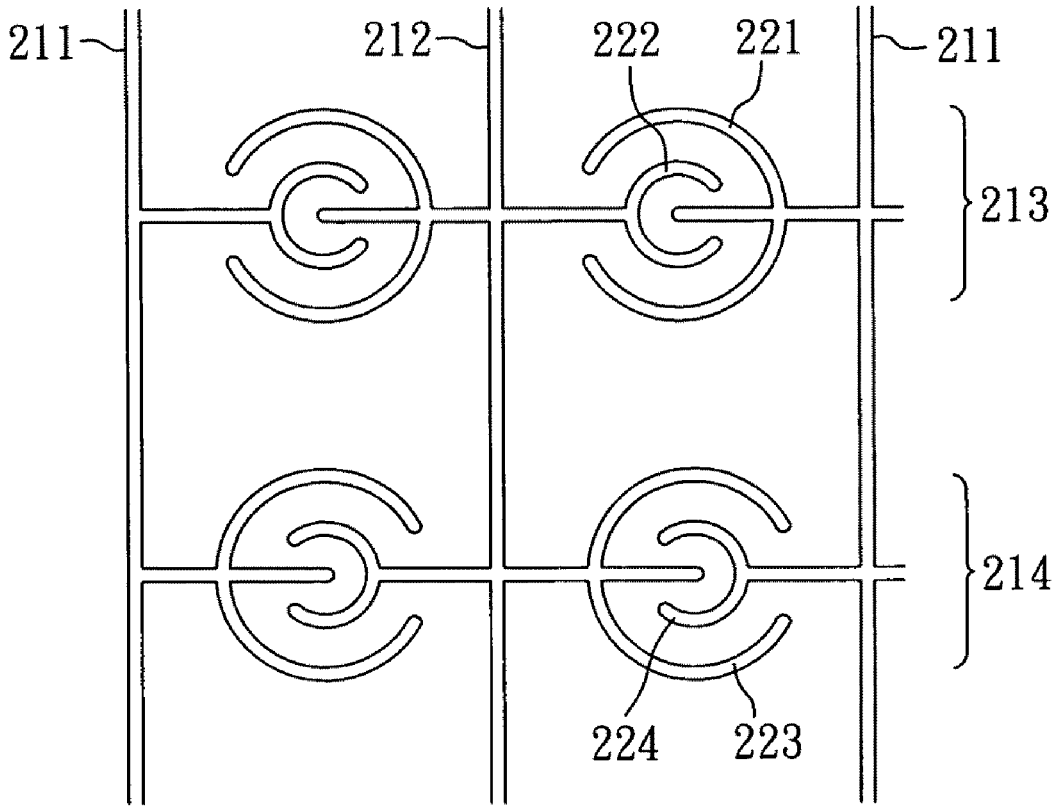
FIG. 2 is an enlarged view of part of the array, which is formed by repeats of planar interdigitated ring electrodes (PIREs) in a preferred embodiment of the present invention.

With reference to FIG. 2, in a PIRE 213, the first conductive line 211 is electrically connected to the first ring-shaped electrode 221 of the PIRE 213 (i.e. the outer ring-shaped electrode 221 in the PIRE 213), and the second conductive line 212 is electrically connected to the second ring-shaped electrode 222 of the PIRE 213 (i.e. the inner ring-shaped electrode 222 of the PIRE 213). On the other hand, in the adjacent PIRE 214, the first conductive line 211 is electrically connected to the first ring-shaped electrode 224 of the PIRE 214 (i.e. the outer ring-shaped electrode in the PIRE 213), and the second conductive line 212 is electrically connected to the second ring-shaped electrode 223 of the PIRE 214 (i.e. the inner ring-shaped electrode of the PIRE 214). Therefore, the electrical polarities of the outer ring-shaped electrodes of every two adjacent PIREs are different. In the present embodiment, the PIREs 213, 214 comprise outer ring-shaped electrodes 221, 223 and inner ring-shaped electrodes 222, 224. The widths of the outer ring-shaped electrodes 221, 223 and the inner ring-shaped electrodes 222, 224 are identical. Furthermore, the outer ringring-shaped electrode 221 and the inner ringring-shaped electrode 222 are interdigitated, and arranged in a form of concentric circles on the surface of the substrate. Besides, the gaps between the outer ring-shaped electrode 221 and the inner ring-shaped electrode 22 are increased in radial direction.

With reference to FIG. 1B, the first conductive lines 111 are connected to an AC signal, and the second conductive lines 112 are connected to the ground. When an AC signal is applied to the PIREs, an electrical potential difference is formed between the outer ring-shaped electrodes of the adjacent PIREs 113, 114. Hence, when cells are injected from the inlets 106 into the assay chamber 104, the cells can be trapped to PIREs via dielectrophoresis force.

Figure 3:
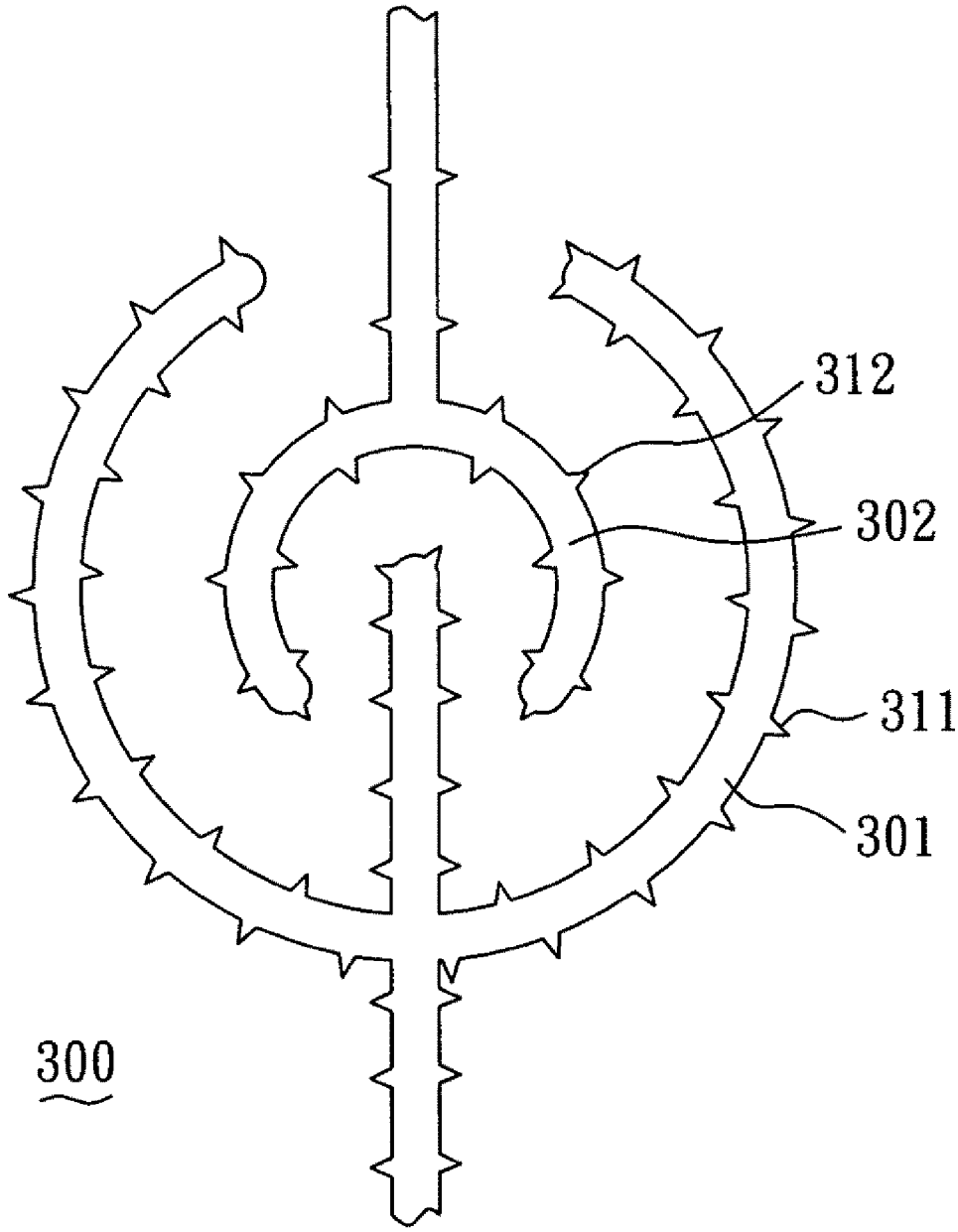
FIG. 3 is enlarged view of a PIRE in a preferred embodiment of the present invention.

With reference to FIG. 3, the outer ring-shaped electrode 301 and inner ring-shaped electrode 302 of the PIRE comprises thorns 311, 312. The function of the thorns 311, 312 is to enhance the electric-field. Hence, the thorns 311, 312 can achieve localized maximum electric-field on the edges of the ring-shaped electrodes, so that cells can be trapped to the electrodes more easily.

On the other hand, as shown in FIG. 4, the cell adhesion layer 461 of the cellular microarray is disposed on the surface of each PIRE 421 to improve cell adhesion. The material of the cell adhesion layer 461 is type one collagen. The cellular microarray chip further comprises a concentration gradient generator 452 to form enclosed channels/chambers for cellular assays.

Hereafter, the manufacturing method of the cellular microarray will be described as follows. First, as shown in FIG. 4A, a layer of ITO film 413, which is used to form electrodes, is coated on the substrate 411. Then, a photoresist 412 is coated on the ITO film 413. The ITO film 413 was micromachined using argon plasma etching to form PIREs 421 (as shown in FIG. 4B). The photoresist 412 is then stripped off in acetone (as shown in FIG. 4C). In order to form a layer of collagen on PIREs 421 later, another photoresist 441 is coated on the substrate 411 (as shown in FIG. 4D). Oxygen plasma is applied to bond a concentration gradient generator 452 to the substrate with micromachined ITO film 413, wherein the concentration gradient generator 452 is made of PDMS. Inlets for cell injection are formed (as shown in FIG. 4E) by punching holes (not shown in FIG. 4E) on the concentration gradient generator 452. After DI water flush, as shown in FIG. 4F, the cellular microarray is incubated in collagen 461 (10 μm/mL, 37° C., 1 hour). Photoresist 441 is removed by ultrasonic agitation in ethanol for 10 min, which may reduce the possible denaturation of collagen comparing to acetone (as shown in FIG. 4G). Finally, the cellular microarray, which is coated with collagen, is flushed in DI water followed by nitrogen drying.

The process for dielectrophoresis cell patterning is described as follows. First, the dielectrophoresis cell patterning buffer (10 mM HEPES, 55 mM D-glucose, 221 mM Sucrose, 1% penicillin/streptomycin, 0.5 mM EGTA; pH 7.0, 300 Osm, 228 μS/cm) was meticulously prepared to ensure long-term cell viability. Cells suspended in the buffer were successively injected into the chamber of the cellular microarray. Then, AC signal (5 Vpp, 5 MHz) was applied to the cellular microarray to pattern cells. After the flow of the cell suspension became steady, $Ca^{2+}$-containing buffer (1.8 mM $CaCl_2$, 274 μS/cm), without EGTA, was injected to sweep away the off-electrode cells, and to promote cell adhesion on the collagen. When the flow of the $Ca^{2+}$-containing buffer became steady, the AC signal was removed. After cells were adhered to the collagen, the $Ca^{2+}$-containing buffer and the dielectrophoresis cell patterning buffer were replaced with Dulbecco's modified Eagle's medium with 10% fetal bovine serum and 1% penicillin/streptomycin. Finally, the cellular microarray with the patterned cells was incubated at 37° C.

Figure 6:
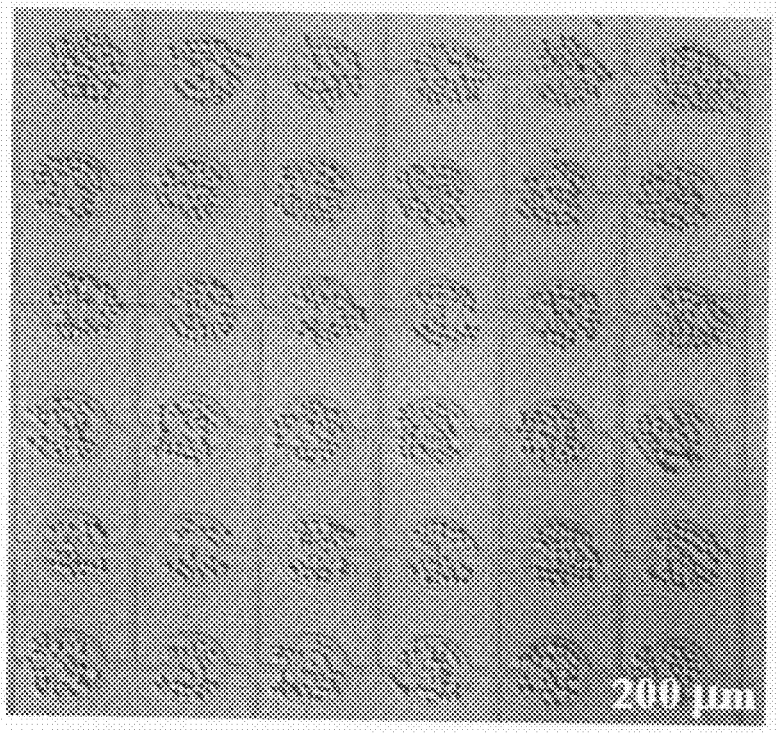
FIG. 6 is a photo of the experimental results in the preferred embodiment of the present invention.
Figure 6:
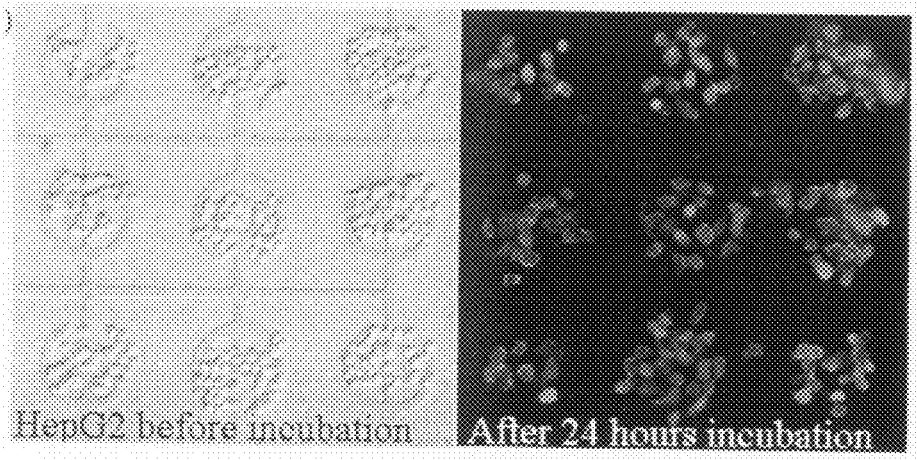

The HepG2 were injected into the cellular microarray. The HepG2 were patterned as cellular microarray via dielectrophoresis force (cell seeding density was 5 million cells/ml; the applied voltage was 5 Vpp, 5 MHz). As shown in FIG. 6A, HepG2 were distributed on PIREs with good uniformity. Hence, a cell pattern with good uniformity can be obtained by using the cellular microarray chip in the present embodiment. Furthermore, after 24 hours incubation, most HepG2 were stained positively with calcein AM (the fluorescent stain for live cells) as shown in FIG. 6B which means that the patterned cells show long-term cell viability on the cellular microarray after 24 hours.

The results in the present embodiment show that the cellular microarray has five advantages:

1. In the cellular microarray of the present embodiment, the PIREs with specific design can trap cells, and the cells can be adhered on the collagen on the substrate uniformly via dielectrophoresis force. Hence, it is possible to perform cell cycle on the cellular microarray of the present embodiment, and the cellular experiments can also be achieved by the cellular microarray of the present embodiment.

2. The results in the present embodiment show that the cellular microarray can be achieved by using small amount of cells and the cells can be patterned in few minutes. However, the conventional technique for preparing cellular microarray, such as microarrayer, consumes hours to several days to provide a cellular microarray.

3. The cellular microarray of the present embodiment can generate different concentration of solution at the same time through the design and the application of the microchannel. Hence, it is possible to test the interaction between the reagent and reagent with different concentration. Therefore, the demands for high throughput can also be achieved.

4. Penicillin/streptomycin and ethylene glycol tetraacetic acid (EGTA) are supplemented in the dielectrophoresis buffer (10 mM HEPES, 55 mM D-glucose, 221 mM Sucrose, 1% penicillin/streptomycin, 0.5 mM EGTA; pH 7.0, 300 Osm, 228 μS/cm) to ensure long-term cell viability and good cell patterns.

5. The stability of the cellular microarray of the present embodiment is good enough for long-time use, due to the simple structure of the cellular microarray.

Embodiment 2

Figure 5:
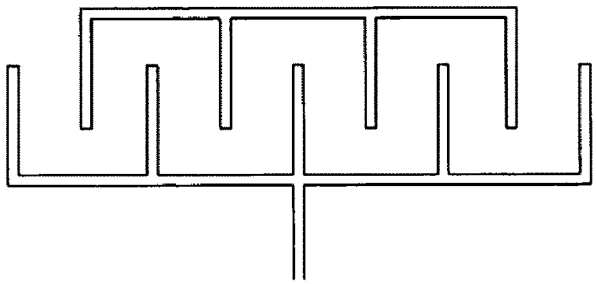
FIG. 5 is a perspective view of a PIRE in the preferred embodiment of the present invention.
Figure 5:
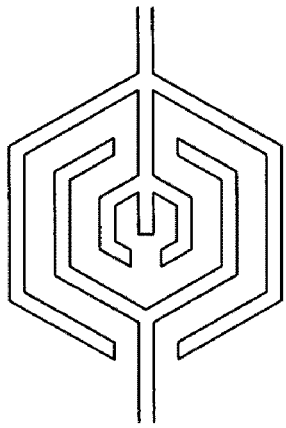
Figure 5:
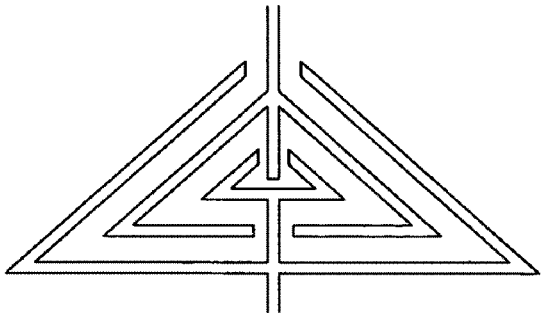

The structure of the cellular microarray and the manufacturing method is the same as described in embodiment 1, except that the shape of the PIRE is designed in a comb-shaped electrode in the present embodiment, as shown in FIG. 5A.

Embodiment 3

The structure of the cellular microarray and the manufacturing method is the same as described in embodiment 1, except that the shape of the PIRE is designed in a hexagonal electrode in the present embodiment, as shown in FIG. 5B.

Embodiment 4

The structure of the cellular microarray and the manufacturing method is the same as described in embodiment 1, except that the shape of the PIRE is designed in a triangle electrode in the present embodiment, as shown in FIG. 5C.

Embodiment 5

The structure of the cellular microarray and the manufacturing method is the same as described in embodiment 1, except that the gaps between the outer ring-shaped electrodes and the inner ring-shaped electrodes of each PIRE are the same.

Embodiment 6

The structure of the cellular microarray and the manufacturing method is the same as described in embodiment 1, except that the first conductive lines and the second conductive lines are poly-segmental.

Embodiment 7

The structure of the cellular microarray and the manufacturing method is the same as described in embodiment 1, except that the material of the electrodes are metal, such as aluminum or chromium.

Although the present invention has been explained in relation to its preferred embodiment, it is to be understood that many other possible modifications and variations can be made without departing from the scope of the invention as hereinafter claimed.

What is claimed is:

1. A cellular microarray, comprising:

I) a substrate;

2) a plurality of first conductive lines located on a surface of the substrate;

3) a plurality of second conductive lines located on the surface of the substrate; and 4) a plurality of paired planar interdigitated electrodes arranged on the surface of the substrate in an array, wherein:

each paired planar interdigitated electrode comprises two members, a first electrode and a second electrode;

the first and second conductive lines are electrically connected to the opposite poles of a voltage source;

the first conductive lines are electrically connected to the first electrodes of each paired planar interdigitated electrode;

the second conductive lines are electrically connected to the second electrodes of each paired planar interdigitated electrode;

one member of each paired planar interdigitated electrode is interdigitated with the other member of the pair;

one member of each paired planar interdigitated electrode comprises a shaped portion that partially surrounds the other member of the pair;

the first electrodes and the second electrodes of each paired planar interdigitated electrode are located on the surface of the substrate; and each of the first and second electrodes of adjacent paired planar interdigitated electrodes partially surrounds and is partially surrounded by the second and first electrodes, respectively, on the surface of the substrate.

2. The cellular microarray of claim 1, wherein the shaped portion of each paired planar interdigitated electrode forms an open polygon, and parts of the first electrodes are linear electrodes or open poly-segmental electrodes.

3. The cellular microarray of claim 1, wherein the shaped portion of each paired planar interdigitated electrode form an open circle or an open ellipse, and parts of the first electrode are arc-shaped electrodes.

4. The cellular microarray of claim 3, wherein the first electrode and the second electrode are arranged in a form of concentric open circles.

5. The cellular microarray of claim 1, wherein the gaps between the first electrode and the second electrode are the same in each paired planar interdigitated electrode.

6. The cellular microarray of claim 1, wherein the widths of the first electrode and widths of the second electrode are the same in each paired planar interdigitated electrode.

7. The cellular microarray of claim 1, wherein the first conductive lines and the second conductive lines are arranged alternately on the surface of the substrate, and each paired planar interdigitated electrode is set between a first conductive line and a second conductive line.

8. The cellular microarray of claim 1, wherein the first conductive lines and the second conductive lines are parallel with each other.

9. The cellular microarray of claim 1, wherein the paired planar interdigitated electrodes form an m×n array, and each m and n is independently an integer of 1 or more.

10. The cellular microarray of claim 1, wherein the shaped portion of the first electrode of each paired planar interdigitated electrode comprises a plurality of thorns.

11. The cellular microarray of claim 1, wherein the shaped portion of the second electrode of each paired planar interdigitated electrode comprises a plurality of thorns.

12. The cellular microarray of claim 10, wherein every distance between the adjacent thorns is the same.

13. The cellular microarray of claim 11, wherein every distance between the adjacent thorns is the same.

14. The cellular microarray of claim 1 wherein the first electrode or the second electrode are metal electrodes or transparent electrodes.

15. The cellular microarray of claim 14, wherein the transparent electrodes are ITO electrodes or IZO electrodes.

16. The cellular microarray of claim 1, further comprising a cell adhesion layer located on a surface of the paired planar interdigitated electrodes or on the surface of the substrate.

17. The cellular microarray of claim 1, further comprising a concentration gradient generator comprising a substrate-forming enclosed channel and/or chambers located above the surface of the substrate to protect the substrate and the plurality of paired planar interdigitated electrodes.

18. The cellular microarray of claim 1, further comprising a concentration gradient generating channel, and a plurality of flow paths, wherein the concentration gradient generating channel and the flow paths are located on the surface of the substrate, and the flow paths connect the concentration gradient generating channel and the paired planar interdigitated electrodes.

* * * * *